US005131651A

United States Patent [19]

You

[11] Patent Number: 5,131,651

[45] Date of Patent: Jul. 21, 1992

[54] BALL BAT

[76] Inventor: Chin-San You, No. 3, Lane 1029, Feng-Shyn Road, Fen Yuan City, Taichung Hsien, Taiwan

[21] Appl. No.: 703,867

[22] Filed: May 21, 1991

[51] Int. Cl.[5] ..... A63B 59/06

[52] U.S. Cl. ..... 273/72 R; 273/80 R

[58] Field of Search ..... 273/67 R, 67 A, 67 D, 273/67 DA, 72 all, 73 J, 80 R, 81.6, 80 B, DIG. 7, 26 B; 81/20, 22

[56] References Cited

U.S. PATENT DOCUMENTS

| | | | |
|---|---|---|---|
| 546,540 | 9/1895 | Kennedy | 273/72 R |
| 729,639 | 6/1903 | McCoy | 273/72 R |
| 780,244 | 1/1905 | Truesdell | 273/72 R |
| 881,266 | 3/1908 | Thompson et al. | 273/73 J |
| 1,531,632 | 3/1925 | Treadway | 273/80 B |
| 1,535,667 | 4/1925 | Horne | 273/80 |
| 2,659,605 | 11/1953 | Tourneau | 273/72 R |
| 3,433,481 | 3/1969 | Tanguay | 273/72 R |
| 3,598,410 | 8/1971 | Costopoulos | 273/72 R |
| 3,618,945 | 11/1971 | Kuchar | 273/72 R |
| 3,623,724 | 11/1971 | Lande | 273/72 R |
| 4,848,745 | 7/1989 | Bohanan et al. | 273/72 R |

FOREIGN PATENT DOCUMENTS

| | | | |
|---|---|---|---|
| 555027 | 7/1943 | United Kingdom | 273/80 R |

*Primary Examiner*—Paul E. Shapiro

*Assistant Examiner*—Mark S. Graham

*Attorney, Agent, or Firm*—Fleit, Jacobson, Cohn, Price, Holman & Stern

[57] ABSTRACT

A ball bat comprises an impact portion, a grip portion, and a flexible bending portion situated between the impact portion and the grip portion. The bat is characterized in that it comprises a fiber-reinforced plastic casing of a predetermined thickness. The slits of a predetermined number are constructed in the casing located at the junction area of flexible bending portion and grip portion. The number of fibers incised to form slits is in a predetermined proportion to the total number of fibers contained in the casing located at the junction area, with the ratio being in the range of 5%-95%. The slits serve to obstruct the transmission of shock from the impact portion to the grip portion of the ball bat. Rigidity and elasticity of the impact portion are different from those of grip and flexible bending portions by virture of an existence of slits disposed in the latter. Rigidity and elasticity of the junction area of flexible bending portion and grip portion can be adjusted by means of slits to an extent that the optimum effect of swinging is attained. A covering layer made of a polymeric material can be used to encase the area, where slits are constructed, for the dual purposes of protecting the area and of absorbing the residue of shock.

16 Claims, 3 Drawing Sheets

BALL BAT

BACKGROUND OF THE INVENTION

The present invention relates to a ball bat, and more particularly to a ball bat, which is made of a fiber-reinforced plastic and is designed to provide a better elasticity and to prevent the shock wave of striking a ball from transmitting to the player's hands holding the bat.

A wooden bat is susceptible to breakage upon hitting a ball even though it provides a better elastic power. On the other hand, a metal bat with a hollow interior provides a better rigidity to make it less susceptible to breakage upon hitting a ball at the expense of elasticity thereof. In addition, a metal bat is defective in that its weight can not be easily and precisely controlled in the course of manufacture thereof. Therefore, a bat made of a fiber-reinforced plastic material has been introduced. The fiber-reinforced plastic bat is characterized in that its weight can be controlled more precisely and that it provides a better strength than a wooden bat. However, the rigidity of the fiber-reinforced plastic bat can not be controlled precisely.

It is a well-known fact a bat bends instantaneously upon hitting a ball, which is subsequently carried by the hitting portion of the bat while the diametric size of the ball is reduced to about three quarters of the size at the threshold of its contact with the bat. The elastic force of the bat is said to reach an ultimate limitation when the bat, which has hit a ball, stops deflecting. Under this condition, the striking force of a player against the ball begins transmitting to the ball so that the ball has power to fly as far as possible. Accordingly, if a bat is provided with excessive rigidity and elastic force, the ball which has been hit by the bat tens to leave the bat before the striking force of the player has a chance to be transmitted to power the ball. As a result, the ball is not able to fly very far. On the other hand, if a bat is not provided with sufficient rigidity and elasticity, it tends to bend excessively upon hitting a ball, thereby resulting in a prolonged contact of the ball with the bat. As a result, the striking force of a player is unable to concentrate on the ball, which can not fly very far accordingly.

The thickness of ball-hitting portion of a prior art bat of a fiber-reinforced plastic material is greatly increased to avert the breakage of the bat upon hitting a ball. As a result, the rigidity of the bat is excessively enhanced to an extent that the striking force of a player fails to exert on the ball.

Furthermore, the outer layers of a prior art bat are generally made of fiber boards pre-impregnated in epoxy resin and are therefore uniform in construction throughout. Therefore, the shock generated at ball-hitting portion of the bat by impact of a ball can be transmitted without obstruction to the handle portion of the bat, resulting in a possible injury to the hands holding the bat.

SUMMARY OF THE INVENTION

It is, therefore, the primary objective of the present invention to provide a ball bat of a fiber-reinforced plastic material with appropriate rigidity and elasticity in accordance with batting requirements of players.

It is another objective of the present invention to provide a ball bat made of a fiber-reinforced plastic material with effective means to avert the transmission of shock from impact portion to grip portion of the bat.

In keeping with the principles of the present invention, the primary objectives of the present invention are accomplished by a ball bat comprising an impact portion, a grip portion, and a flexible bending portion situated between the impact portion and the grip portion. The bat is characterized in that it comprises a fiber-reinforced plastic outer shell of a predetermined thickness. The slits of a predetermined number are constructed in the outer shell located at the junction area between the flexible bending portion and the grip portion. The number of fibers incised to form slits is in a predetermined proportion to the total number of fibers contained in the outer shell located at junction area of flexible bending portion and grip portion, with the ratio being in the range of 5%-95%. The slits serve to obstruct the transmission of shock from the impact portion to the grip portion of the bat. In addition, rigidity and elasticity of the impact portion are different from those of grip and flexible bending portions by virtue of an existence of slits disposed in the latter. In other words, rigidity and elasticity of the junction area of flexible bending portion and grip portion can be adjusted by means of slits to an extent that the optimum effect of swinging is attained. In addition, a covering layer of a polymeric material can be used to encase the area, where slits are constructed, for the dual purposes of protecting the area and of absorbing the residue of shock.

The ball bat embodied in the present invention is further characterized in that the covering layer comprises therein an appropriate number of inlay pieces, which may be made of materials with a predetermined rigidity, such as metals, composite materials, wood, ceramic material, fiber-reinforced plastic, etc. In view of absorbing the residue of shock, the inlay pieces may be made of materials capable of absorbing shock, such as plastic, rubber, foamed plastic material, etc.

DETAILED DESCRIPTION OF THE PREFERRED EMBODIMENTS

Figure 1:
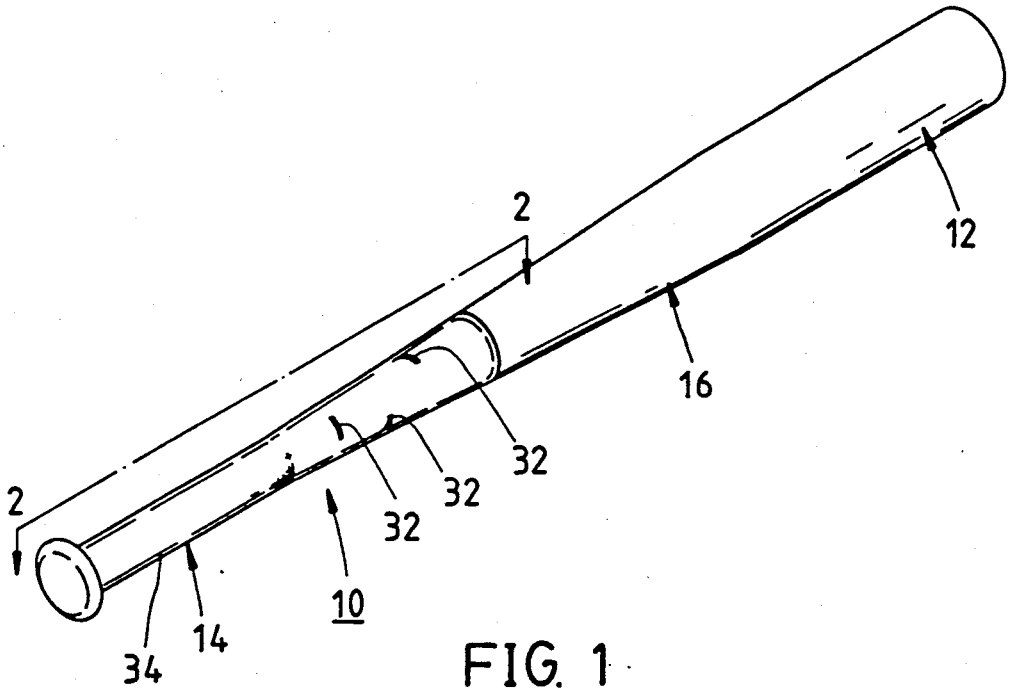
FIG. 1 shows a three-dimensional view of the first preferred embodiment of the present invention, in which the covering layer is indicated by a transparent layer.
Figure 2:
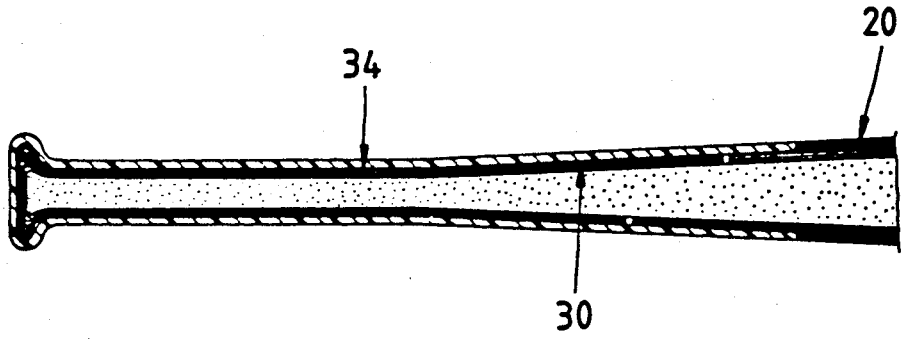
FIG. 2 shows a cut-away view of a portion taken along line 2—2 as shown in FIG. 1.
Figure 3:
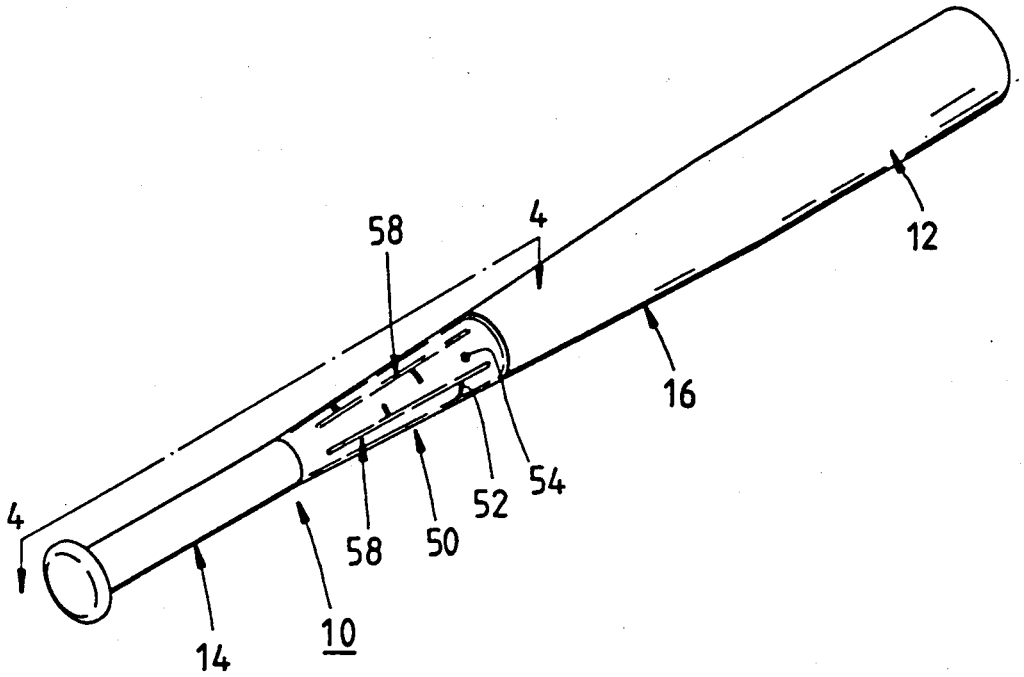
FIG. 3 shows a three-dimensional view of the second preferred embodiment of the present invention, in which the covering layer is represented by a transparent layer.
Figure 4:
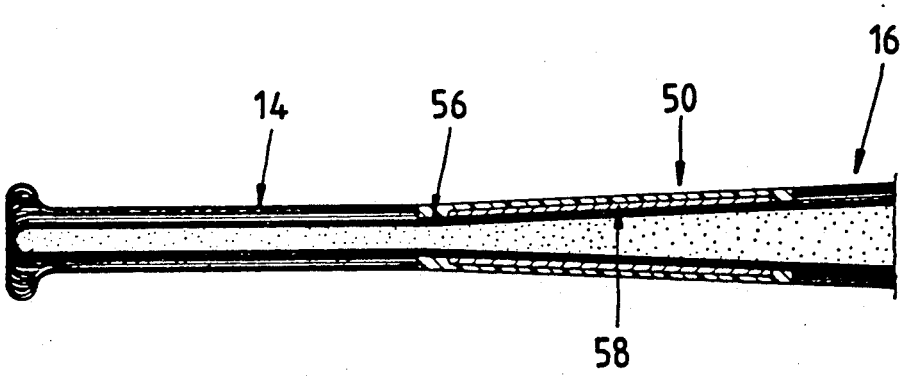
FIG. 4 shows a cut-away view of a portion taken along line 4—4 as shown in FIG. 3.
Figure 5:
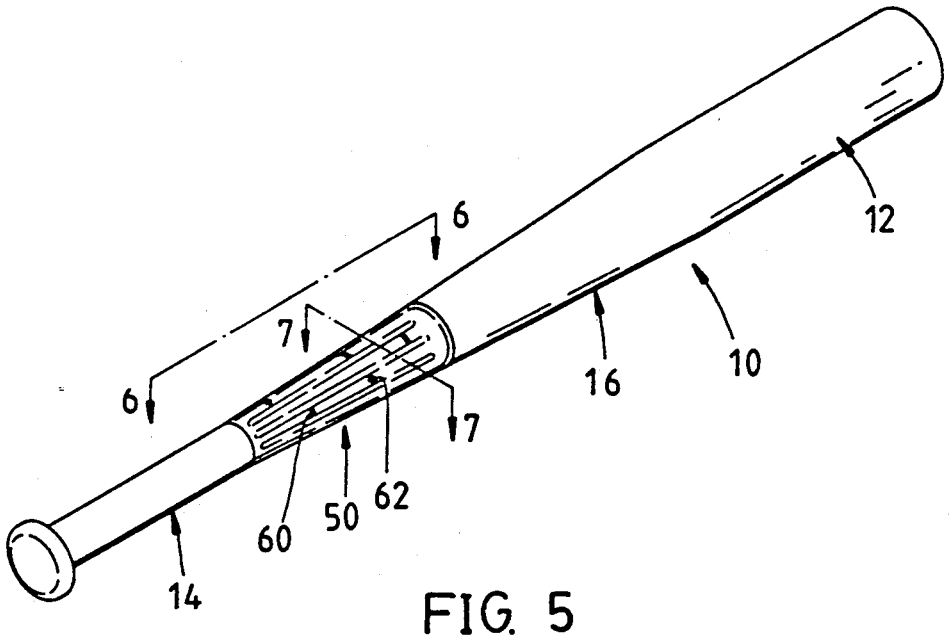
FIG. 5 shows a three-dimensional view of the third preferred embodiment of the present invention, in which the covering layer is also indicated by a transparent layer.
Figure 6:
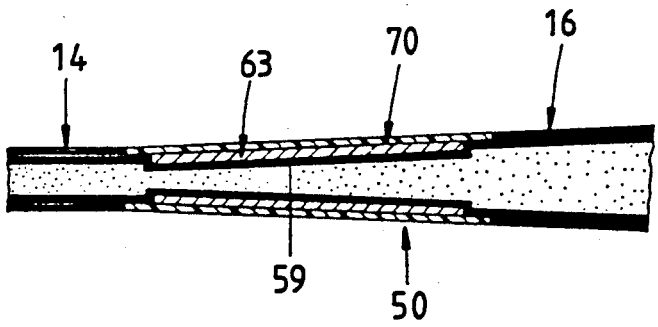
FIG. 6 shows a cut-away view of a portion taken along line 6—6 as shown in FIG. 5.
Figure 7:
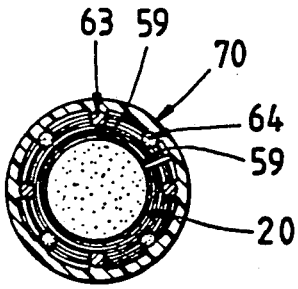
FIG. 7 shows a cut-away view of a portion taken along line 7—7 as shown in FIG. 5.

Referring to FIGS. 1-7, the ball bat 10 embodied in the present invention is shown comprising an impact portion 12, a grip portion 14, and a flexible bending portion 16 which is situated between the impact portion 12 and the grip portion 14 and is made into a unitized body along with impact portion 12 and grip portion 14. The ball bat 10 embodied in the present invention is made from a plurality of carbonaceous fiber boards pre-impregnated in epoxy resin, which are intertwined in such a manner that fibers are arranged in accordance with the predetermined orientations. Thereafter, the intertwined fiber boards are made into a ball bat 10 in a mold under heat and pressure. The ball bat 10 further comprises a multi-layered outer shell 20, which is made of a fiber-reinforced plastic material by means of pressing and molding.

The ball bat 10 of the first embodiment of the present invention is characterized in that the surface of a designated area 30, which is in fact a junction area between the flexible portion 16 and the grip portion 14, comprises a plurality of slits 32 of a predetermined depth, which are randomly arranged thereon. The sum of the cut fibers in slits 32 is about 25% of the sum total of fibers in the junction area 30. In addition, the junction area 30 is further encased with a covering layer 34 of a plastic material by means of injection molding. The covering layer 34 provides greater rigidity and elasticity to junction area 30 where a plurality of slits 32 are located. The transmission of shock generated in the impact portion 12 to the grip poriton 14 is effectively obstructed by means of slits 32. Furthermore, the covering layer 34 serves to absorb the residue shock.

The ball bat 10 of the second embodiment of the present invention comprises an annular recess 50 located at the junction area of the flexible bending portion 16 and the grip portion 14. The surface of recess 50 comprises a plurality of slits 52 and perforations 54 arranged randomly throughout. The sum of the cut fibers in slits 52 and perforations 54 is about 40% of the sum total of fibers in the recess 50. In addition, the recess 50 is further encased with a covering layer 56 of plastic material by means of injection molding. If necessary, a plurality of reinforcing strips 58 of fiber-reinforced plastic material may be embedded in the recess 50 prior to encasing the recess 50 with a covering layer 56. The obstruction of transmission of shock from the impact portion 12 to the grip portion 14 is effectively achieved by means of slits 52, perforations 54 and covering layer 56 while the enhancement of elasticity and rigidity of the ball bat 10 is attained with the aid of reinforcing strips 58.

The ball bat 10 of the third embodiment of the present invention is characterized in that the surface of annular recess 50 is composed of eight grooves 59, which are spaced at equal intervals and are parallel to the long axis of the ball bat 10. Located at the interspace of grooves 59 are a plurality of slits 60 and perforations 62 arranged randomly. The sum of the cut fibers in slits 60 and perforations 62 is about 60% of the sum total of fibers in the recess 50. In addition, some of grooves 59 may contain therein reinforcing strips 63 made of fiber-reinforced plastic material while the rest of grooves 59 comprises therein shock-absorbing strips 64 of plastic material. Furthermore, a plastic covering layer 70 is used to encase the recess 50 for the purpose of absorbing the residue of shock. As a result, the shock originating at the impact portion 12 of the ball bat 10 is effectively reduced to a minimum by means of slits 60, perforations 62, shock-absorbing strips 64, and covering layer 70. The optimum rigidity of the flexible bending portion 16 for the best swinging effect can be properly adjusted through the combined usage of slits 60 and reinforcing strips 63.

The embodiments of the present invention described above are to be considered in all respects as merely illustrations of principles of the present invention. Accordingly, the present invention is to be limited only by the scope of the hereinafter appended claims.

What I claim is:

1. A ball bat comprising a fiber-reinforced outer shell having an impact portion, a grip portion, a flexible bending portion situated between said impact portion and said grip portion, and a junction area between said flexible portion and said grip portion wherein the junction area includes a plurality of discrete cuts each severing fibers of the outer shell for reducing shock transmission from the impact portion to the grip portion, with the number of fibers severed by cuts being 5%-95% of the total fibers in said junction area.

2. A ball bat in accordance with claim 1, wherein said cuts comprise slits of a predetermined width and length extending transversely in relation to a longitudinal axis of the bat.

3. A ball bat in accordance with claim 1, wherein said cuts are perforations of a predetermined diameter.

4. A ball bat in accordance with claim 1 wherein said junction area is encased with a covering layer made of polymeric material.

5. A ball bat in accordance with claim 4, wherein said junction area comprises a recess of predetermined depth and length, which includes said cuts and is encased by said covering layer.

6. A ball bat in accordance with claim 4, wherein said covering layer comprises therein a plurality of inlay pieces made of a predetermined material.

7. A ball bat in accordance with claim 4, wherein said junction area comprises therein a plurality of grooves spaced at equal intervals, with each of said grooves having an inlay piece embedded therein.

8. A ball bat in accordance with claim 5, wherein said recess is of annular shape.

9. A ball bat in accordance with claim 5, wherein said recess comprises on the surface thereof a plurality of grooves spaced at equal intervals, with each of said grooves having an inlay piece embedded therein.

10. A ball bat in accordance with claim 6, wherein said inlay pieces are made of material having a predetermined rigidity.

11. A ball bat in accordance with claim 6, wherein said inlay pieces are made of material having a shock-absorbing property.

12. A ball bat in accordance with claim 2, wherein the number of fibers severed by the slits are about 40% of the total number of fibers in the junction area.

13. A ball bat in accordance with claim 1, wherein the cuts include perforations of specified diameter and transverse slits.

14. A ball bat in accordance with claim 13, wherein the fibers severed by the cuts are about 60% of the total number of fibers in the junction area.

15. A ball bat in accordance with claim 14, wherein the fibers severed by the cuts are about 40% of the total number of fibers in the junction area.

16. A ball bat in accordance with claim 2, wherein the slits are in different transverse planes respectively.

* * * * *